United States Patent [19]

Aschauer et al.

[11] Patent Number: 4,635,754

[45] Date of Patent: Jan. 13, 1987

[54] RESCUE FROM AN AVALANCHE

[75] Inventors: Peter Aschauer; Michael Aschauer, both of Gräfelfing; Helmuth Bauer, Malgersdorf, all of Fed. Rep. of Germany

[73] Assignee: Firma Peter Aschauer, Gräefelfing, Fed. Rep. of Germany

[21] Appl. No.: 615,744

[22] PCT Filed: Oct. 6, 1983

[86] PCT No.: PCT/EP83/00262

§ 371 Date: Jul. 26, 1984

§ 102(e) Date: Jul. 26, 1984

[87] PCT Pub. No.: WO84/01300

PCT Pub. Date: Apr. 12, 1984

[30] Foreign Application Priority Data

Oct. 6, 1982 [DE] Fed. Rep. of Germany ..... 3237060

[51] Int. Cl.[4] ..... A63B 29/02

[52] U.S. Cl. ..... 182/3; 441/93

[58] Field of Search ..... 182/3; 441/87, 92, 93, 441/94, 108

[56] References Cited

U.S. PATENT DOCUMENTS

| | | | |
|---|---|---|---|
| 2,782,430 | 2/1957 | Radnofsky | 441/94 |
| 4,105,173 | 8/1978 | Bucker | 182/3 |
| 4,500,014 | 2/1985 | Zimmerly | 441/92 |
| 4,551,106 | 11/1985 | Prager | 441/94 |

FOREIGN PATENT DOCUMENTS

| | | | |
|---|---|---|---|
| 3300841 | 12/1983 | Fed. Rep. of Germany | 182/3 |
| 2081660 | 2/1982 | United Kingdom | 182/3 |

*Primary Examiner*—Reinaldo P. Machado
*Attorney, Agent, or Firm*—George E. Kersey

[57] ABSTRACT

Rescue apparatus and method. The apparatus includes a tear-resistant balloon bound to a frame that is securable to a person. To initiate rescue action, the ballon is inflated by pressurized gas to buoy the attached person at, for example, the surface of the avalanche. The apparatus is formed by a frame with a collar to which the balloon is attached. A filling mechanism for the balloon is positioned within the frame and includes a nozzle valve that operates in accordance with Venturi action.

19 Claims, 9 Drawing Figures

Fig 1
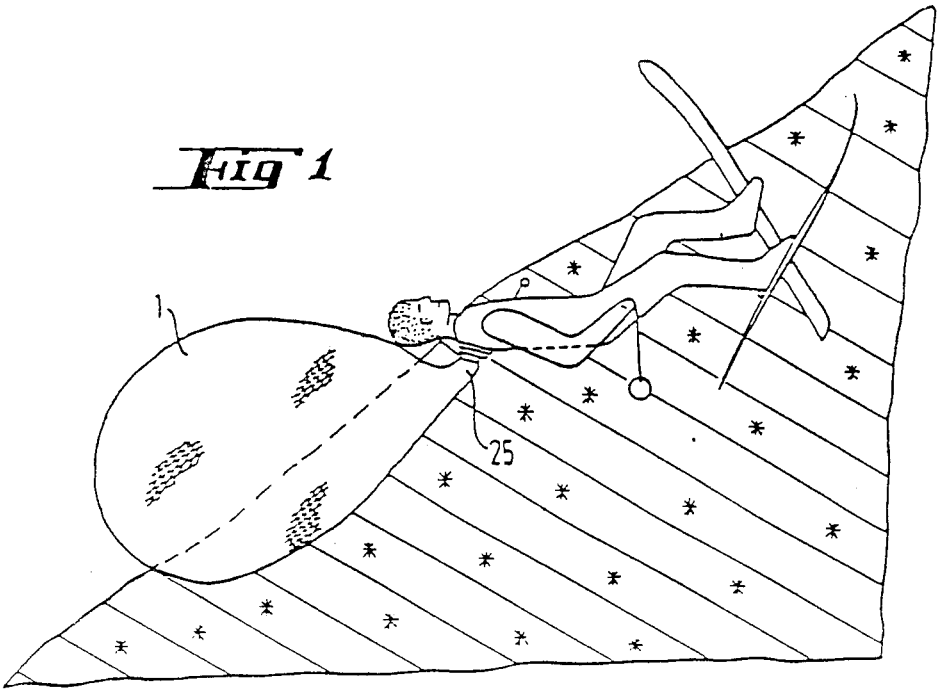
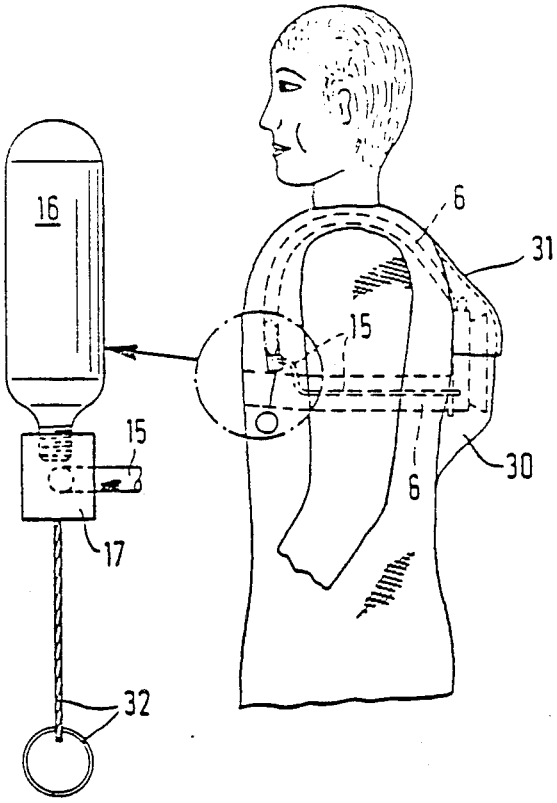
Fig. 2

RESCUE FROM AN AVALANCHE

The invention relates to rescue apparatus in which using a tear-resistant baloon is attached to the person and is inflated to keep the person near the surface of the avalanche.

An apparatus of this type is described in the German patent specification No. 23 26 850.

The present invention is based on the problem of developing an apparatus of the type such that it meets requirements in practical use with respect to functional safety during release, during inflation of the balloon, during actual use, and during repeated use.

In order to solve these problems, an embodiment of the balloon, as well as a filling apparatus connected thereto, is disposed within a frame as well as in such that the balloon has its filling opening gripping a collar of a rigid frame which interiorly contains the filling apparatus.

In accordance with a plurality of inventive embodiments release of the rescue apparatus and inflating the balloon is provided mechanically by means of a rip-cord, or pneumatically by means of an additional pressure gas bottle, besides the essential pressure gas bottles directly connected to the filling apparatus, to fill the balloon.

With respect to the operation of the rescue apparatus it is essential that the full pressure of the gas from the pressure gas bottles connected to the filling apparatus be available at the moment when the balloon opens and that the venturi-effect of the venturi nozzles, by means of which the balloon is filled, is slightly delayed. Upon further inflating the balloon, then the venturi comes in effect. In an area of reduced hydrostatic pressure but high flow velocity in the venturi nozzles ambient air is drawn in and utilized in addition to the pressure gas filling for inflating the balloon. This makes it possible to use smaller pressure gas bottles.

Upon automatic opening of the balloon, the function of a non-return valve in the vicinity of the air-suction aperture is of particular significance. This non-return valve closes off the air suction aperture at the moment when the pressure gas bottle is punctured, which produces, in the vicinity of the venturi nozzles, a short-time head pressure in a direction opposite to the direction of filling. Only after the counter pressure from the balloon has ceased, that is to say after the balloon has unfolded, the flow is effected through the venturi nozzles in the filling direction, ambient air being drawn in through the same air suction aperture with the non-return valve now in the open position. The air suction aperture is preferably protected, being located in the interior of the frame, thus blockage during use being impossible. However, for reasons of safety, the available quantity of pressure gas is to be chosen such that the balloon receives a sufficient filling although, without incorporating ambient air, this is less than the filling normally provided. Such a case may occur in practice, if the wearer of the rescue apparatus is late in actuating it, i.e. only after the moment when he and the rescue apparatus are already within the mass of snow of an avalanche.

A further pressure gas bottle beside the pressure gas bottles being connected to the filling apparatus serves for additional safety in filling the balloon, if, according to another embodiment of the invention, a gas actuated release device is provided. First, the gas filling in this additional pressure gas bottle serves for actuating the piston, to which the valve needles for opening the pressure gas bottles connected to the filling apparatus are connected. After the pressure gas bottle closures have been pierced by the valve needles, the pressure gas bottle of the release device may also contribute to the filling of the balloon.

After the pressure gas bottles have been emptied, the suction effect of the venturi nozzles is finished so that the pressure from the balloon impends in the opposite direction to the non-return valve in the air inlet aperture, thus effectively preventing the balloon from deflating. Numerous embodiments of the gas-actuated and the mechanical release device are conceivable within the scope of the present invention. The filling device disposed in the interior of the frame is housed such that being protected. The frame itself may be secured to the wearer's back by means of straps; it may also be incorporated within a closure flap on the back of the jacket or an overall or the like clothing; finally, it may also be accomodated within the pocket of a rucksack. In the accomodation care must always be taken not to hinder the automatic opening of the balloon. Therefore, closure flaps secured by means of releasable closures are appropriate.

Instead of a freely vibrating non-return valve, it is also possible to provide a forcibly controlled valve which for example may be actuated against spring load, said valve taking an opening or closing position dependent on pressure or counter pressure upon the valve flap. The provision of suitable embodiments may be left to the judgement of the expert.

For the reason of saving weight, the frame within which the filling apparatus is arranged is preferably made of a rigid plastic such as polyamide. A suitable frame material for the filling apparatus itself is aluminium; however, cold resistent plastics, for example PTFE, come into question. The pressure hose for the gas actuated release device is also preferably of PTFE or a similar suitable material. This ensures, that adequate resiliency is maintained at the low temperatures associated with expanding compressed gas.

A preferred example of the present invention will now be described with reference to the drawing, the released device being described by means of two variants, one mechanical and one pneumatic.

In the drawings:

FIG. 1 illustrates a skier swimming on an avalanche by means of the rescue apparatus, FIG. 2 shows a person carrying a rescue apparatus on his back;

Figure 3:
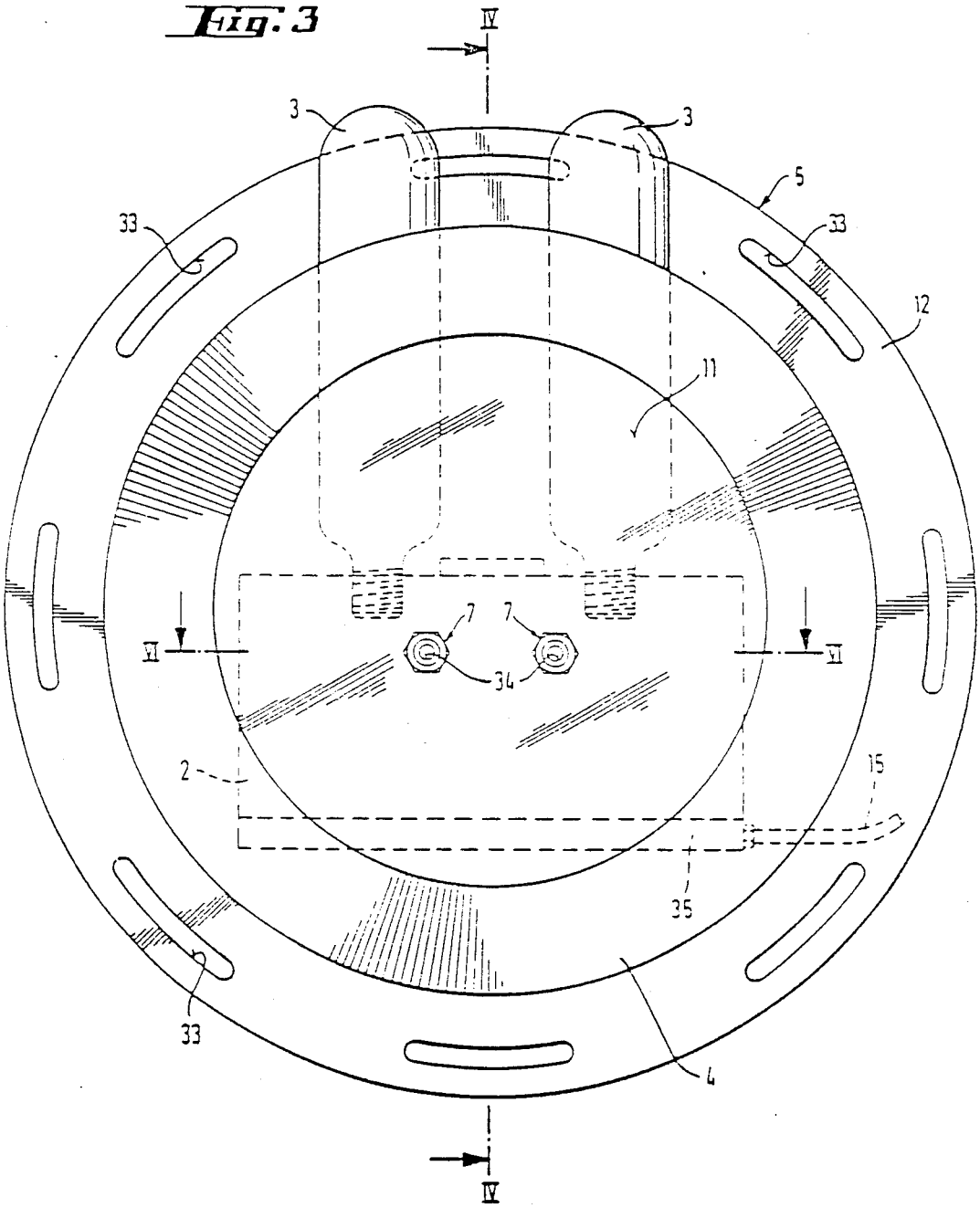
FIG. 3 is a plan view of the filling apparatus on the side remote from the wearer's back.

FIG. 1 shows a skier on a mass of snow of an avalanche with a rescue apparatus on his back. A balloon 1 of the apparatus is inflated, thus moving the skier on the surface of the avalanche in a downward direction. As a result of the close body connection between the balloon and the wearer, the wearer's head is kept near the surface of the avalanche.

This close body connection is shown here by a short balloon neck 25 which defines the filling aperture of the balloon and has an end 26 (FIG. 4) folded over a collar part 4 of a frame 5 of the rescue apparatus. Behind the collar part 4, end 26 of balloon neck 25 is enveloped around a rubber ring 27. The enveloped part lies upon an angular rubber insert 28 and is tied together sealingly from the outside by means of a steel strap 29.

Referring to FIG. 2, the rescue apparatus is mounted to the wearer's back by means of straps 6. Such straps pass over the shoulders shoulders, extend around the chest and are fixed and secured by closures not shown. Additionally straps may also pass between the legs. However, such a measure may be despensed with if the rescue apparatus is sewn securely. In order to increase safety, however, the straps may also be adapted to integrate the rescue apparatus into a piece of clothing. The outside of the rescue apparatus is covered by a closure flap 30 for the folded balloon being held within the closure flap 30. Upwardly the closure flap 30 is closed by a cover 31. It is useful for the flap 30 and the cover 31 to be sewn to the back of the clothing only along their top and bottom edges, with the sides being fixed by releasable closures. The latter are ripped open when the balloon is inflated so that the balloon, when flap 30 and cover 31, resp., have fallen off, can open up freely towards the rear. At the front side, that is on wearer's chest, a release device is provided. In case of FIG. 2 a pneumatic release device being shown. This device essentially comprises a pressure gas bottle 16 screwed on a valve 17, which is opened by pulling on grip cord 32. Valve 17 communicates with the filling apparatus on the wearer's back trough a pressure hose 15.

FIG. 3 shows the filling apparatus 2, being covered by the bottom of the frame 5 of the rescue apparatus in the chosen illustration. Frame 5 is shaped somewhat like a pot, edge 12 thereof facing the wearer's back being bent outwardly in the form of a flange. Located around the periphery of the frame are arcuate slots for mounting straps. The bottom of the pot-shaped frame comprises a collar part 4, around which the aperture of the balloon is passed, as shown more clearly in FIG. 4. Projecting through the bottom of the pot are blow-off apertures 34 of two venturi nozzles 7 arranged in the interior of the filling apparatus 2. A housing cover 35 on the underside of the filling apparatus 2 includes connecting ducts shown in greater detail in the cross-section in FIG. 5. The ducts allow the pressure gas from pressure hose 15 of the release device to admit a piston 23, which includes valve needles 18 adapted to pierce the closures of the pressure gas bottles 3. The externally threaded necks of the pressure gas bottles are screwed into corresponding threaded holes in the filling apparatus 2. Die ends of the pressure gas bottles 3 project through the lateral wall of frame 5 of the rescue apparatus so that the bottles may be screwed in or out, resp., from the outside.

Figure 4:
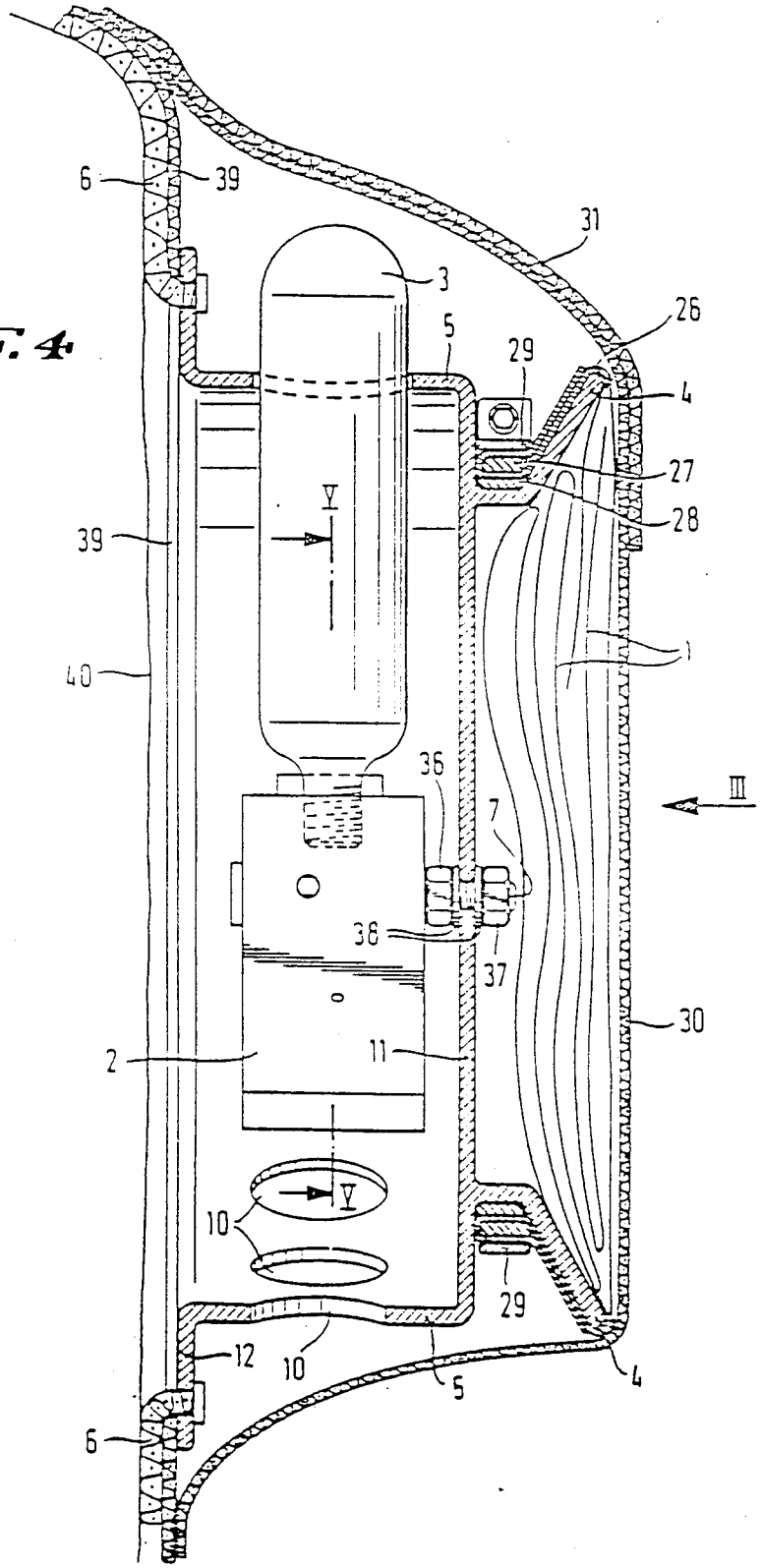
FIG. 4 shows a cross section through the frame containing the filling apparatus.

FIG. 4 shows a cross section through the rescue apparatus along section line IV—IV of the FIG. 3. Additional apertures 10 are visible in the lateral wall of frame 5. Through these apertures air may enter into the frame so that said air is available to be drawn through venturi nozzles. Behind closure flap 30 and cover 31 in the interior of collar part 4 balloon 1 which is in a folded condition lies upon the frame bottom 11. The filling apparatus 2 which is formed as an aluminium block is secured to the bottom of the pot by screwing the extensions of the venturi nozzles on both sides, said extensions jutting beyond the filling apparatus. A nut 36 within the interior of the frame as well as a nut 37 on the outside of the frame are adapted for this screwing, said nuts being braced against the bottom wall 11 of the frame through washers 38. Moreover, additional attachment means not shown, may be provided to secure the filling apparatus 2 within the interior of the frame 5. Straps 6 are secured to the housing 5 and pass through a jacket 39 over the wearer's back 40, so that the rescue apparatus as a whole is tied firmly between the shoulder blades of the wearer.

Figure 5:
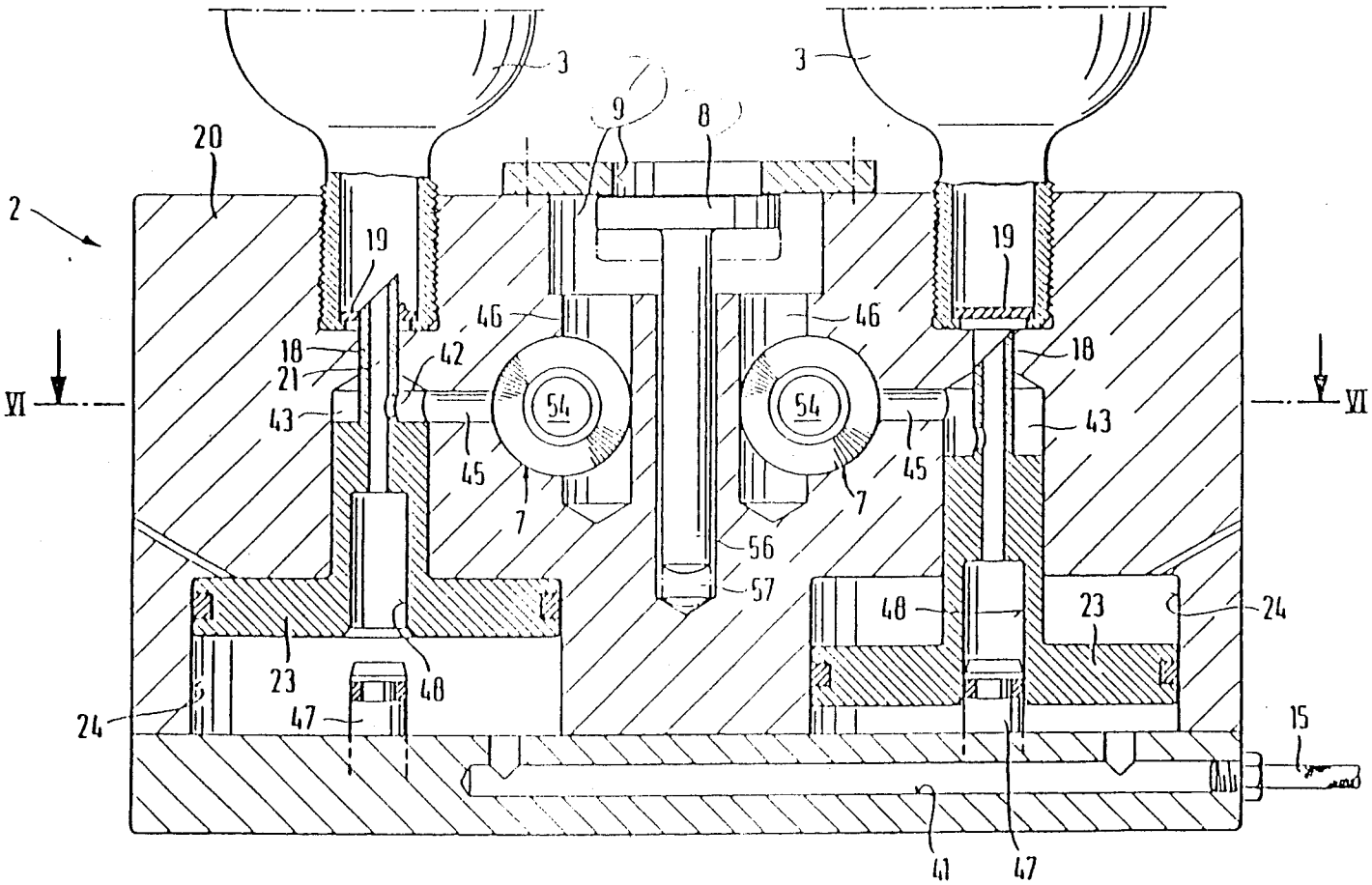
FIG. 5 shows a cross section through the filling apparatus in a plane passing through the longitudinal axis of the valve needle.

According to FIG. 5, which is a cross section view along section line V—V of FIG. 4, the housing block 20 of the filling apparatus 2 has an air suction aperture 9 between both pressure gas bottles 3. The air suction aperture 9 is closed off when the balloon is inflated by the counter pressure from the interior thereof by the non-return valve 8, as in the position shown. This floatingly supported non-return valve also assumes the same position at the moment when gas pressure from the pressure gas bottles 3 comes across the still folded balloon, thus the balloon counter pressure is held back. On the other hand, non-return valve 8 releases air suction aperture 9 while the balloon is being filled by utilization of the venturi effect of the two venturi nozzles, that is the non-return valve is located in the lower position, shown in dotted lines in FIG. 5.

According to FIG. 5, valve needles 18, by means of which closure plug 19 of pressure gas bottles 3 are pierced, are shown in different positions. When connecting duct 41 is without pressure, piston 23 with valve needle 18 is in position shown on the right hand side, that is, the point of valve needle 18 is just below closure plug 19 of its associated pressure gas bottle 3. If connecting duct 41 is admitted through pressure hose 15 from pressure gas bottle 16 of the pneumatic release device, piston 23 is in the position of the left piston according to FIG. 5. In this position, the piston has pierced closure plug 19 of the corresponding pressure gas bottle 3, thus the content thereof are emptied by the bore 21 of the valve needle 18. The valve needle 18 has a lateral bore 42 opening into an annular space 43. As shown in the cross-section in FIG. 6, the annular space 43 is connected through puncture boring 44 to a transverse boring 45 opening into the associated venturi nozzle 7. Air-suction slot 22 thereof is internally connected through a blind end bore 46 to orifice 9. Located in each cylinder 24 of pistons 23 is a guide pin 47 engaging in a central bore 48 in each piston. Bore 21 of needle 18 opens into the central bore 48. As long as the guide pin is engaged in central bore 48 the full gas pressure in connecting duct 41 acts upon piston 23 until the latter has pierced closure plugs of pressure gas bottle 3. Only then does the guide pin 47 release central bore 48, so that the pressure gas which continues to flow through connecting duct 41 reaches, from pressure gas bottle 16 of the release device, venturi nozzles 7 through central bore 48, bore 21 of the valve needle 18 and lateral bore 42 thereof. This allows the pressure gas amount from bottle 16 of the release device also to be used to fill the balloon.

Figure 6:
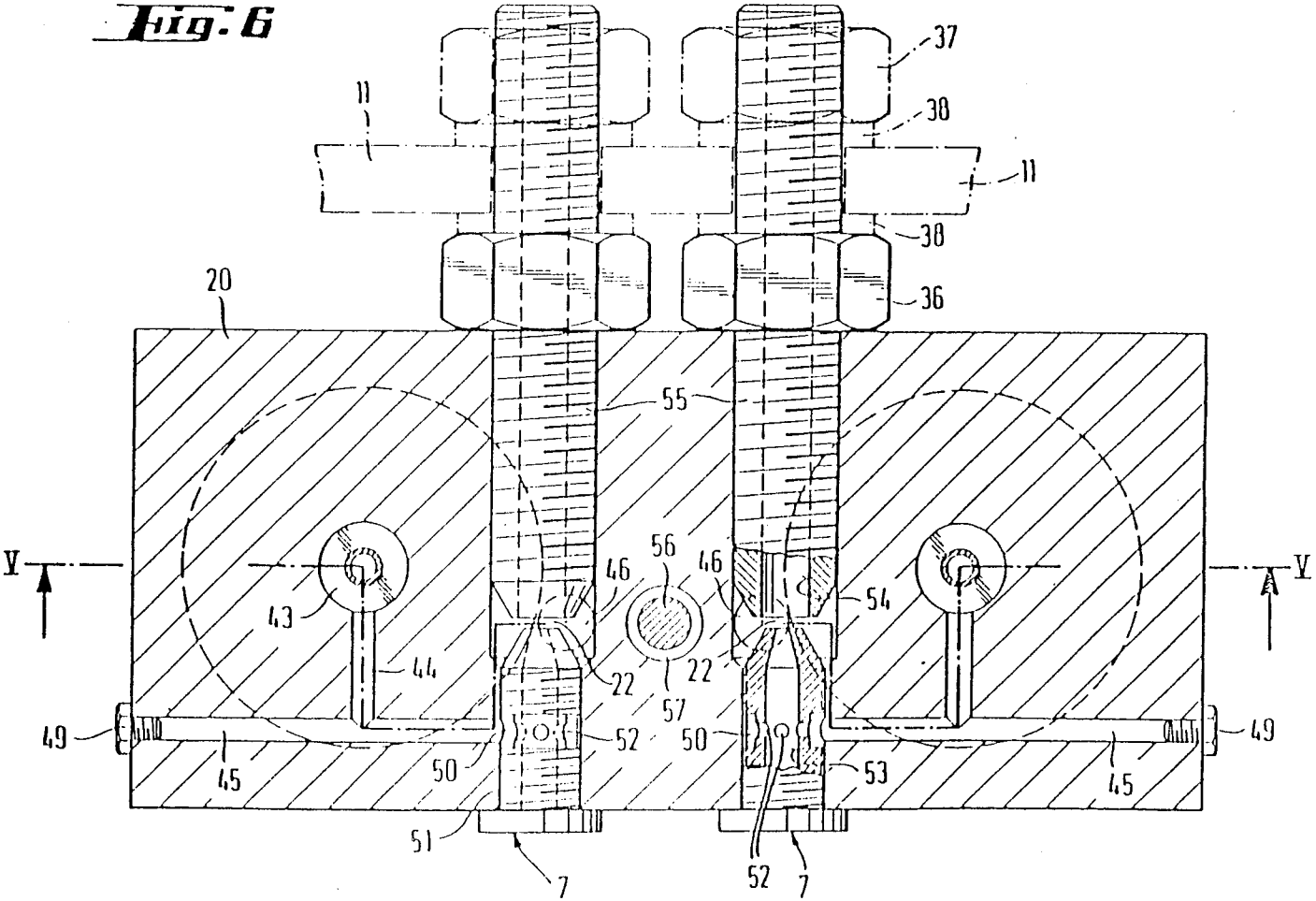
FIG. 6 is a cross section through the filling apparatus in a plane passing through the longitudinal axis of the venturi nozzles.

With reference to FIG. 6 it may be seen quite clearly how the transverse boring 45 is closed off from the outside by threaded plug 49 while on the other hand said transverse boring 45 is opening into filling chamber 50 of venturi nozzle 7 which is formed by two parts. An inlet nozzle 51 is in communication with filling chamber 50. Therefrom the pressure gas passes through a plurality of transverse borings 52 into axial nozzle duct 53, flows at the restricted outlet from axial nozzle duct 53 through air suction slot 22, and reaches as a mixture of gas and air axial nozzle duct 54 of outlet nozzle part 55 of venturi nozzle 7. Between the two venturi nozzles 7 there may be seen in cross-section, the valve tappet 56 of non-return valve 8, the tappet being guided loosely in a bore 57 in housing block 20.

Figure 7:
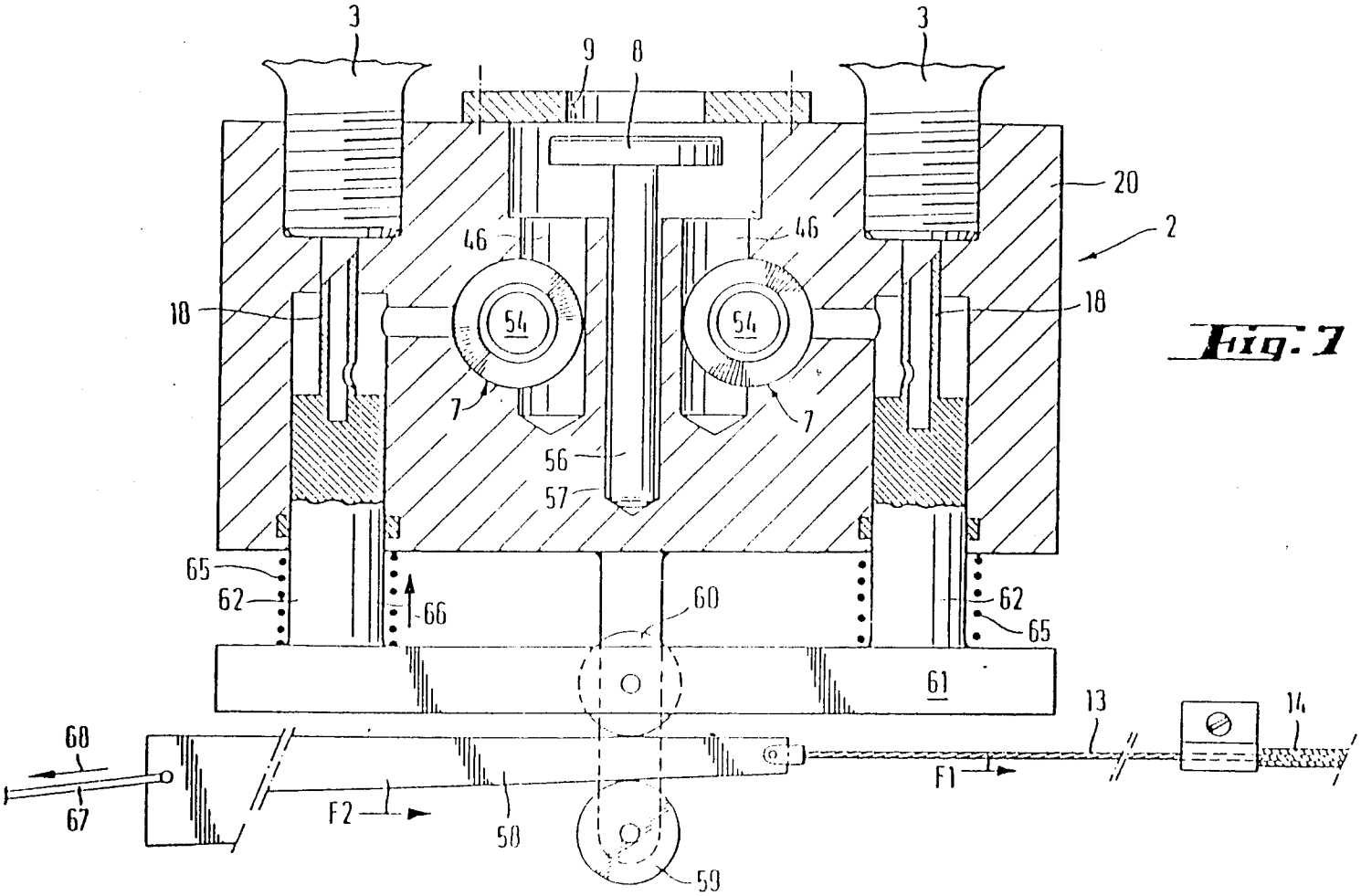
FIG. 7 is a cross section through an filling apparatus having a mechanical release device.

According to FIG. 7 there is illustrated an alternative release device, in which the hydraulic release device is replaced by a mechanical release device. In a pressure tight tube, a rip cord 13, is guided in the manner of a Bowden wire. In pulling the rip cord in the direction of arrow F1, a wedge shaped actuating strip 58 is drawn through between a lower roller 59 and an upper roller 60. The upper roller 60 is supported in a transverse beam 61 to which piston parts 62 are attached. These engage in corresponding bores in housing blocks 20 and carry valve needles 18 at their upper ends. When the actuating strip 58 moves in the direction of arrow F2, transverse beam 61 strikes valve needes 18 to move upwardly, where the valve needles 18 pierce corresponding closure plugs in pressure gas bottles 3. According to FIG. 7 the non-return valve 8 is shown in its lower position, whereat the tappet 56 thereof rests on the bottom of the boring 57. The flow way of pressure gas emerging from opened bottles 3 is as in the example of the embodiment illustrated in accordance with FIGS. 5 and 6.

Transverse beam 61 is urged towards lower roller 59 by compression springs 65 supported between said beam and the housing block 20 and surrounding piston parts 62. Thereby it is achieved that valve needles 18 are returned from their operative positions to their starting positions consequently in a direction opposite to the actuating direction according to arrow 66. This return actuation is effected by moving actuating strip 58 to the left, that is by pulling to actuating cord 67 in the direction of arrow 68.

Figure 8:
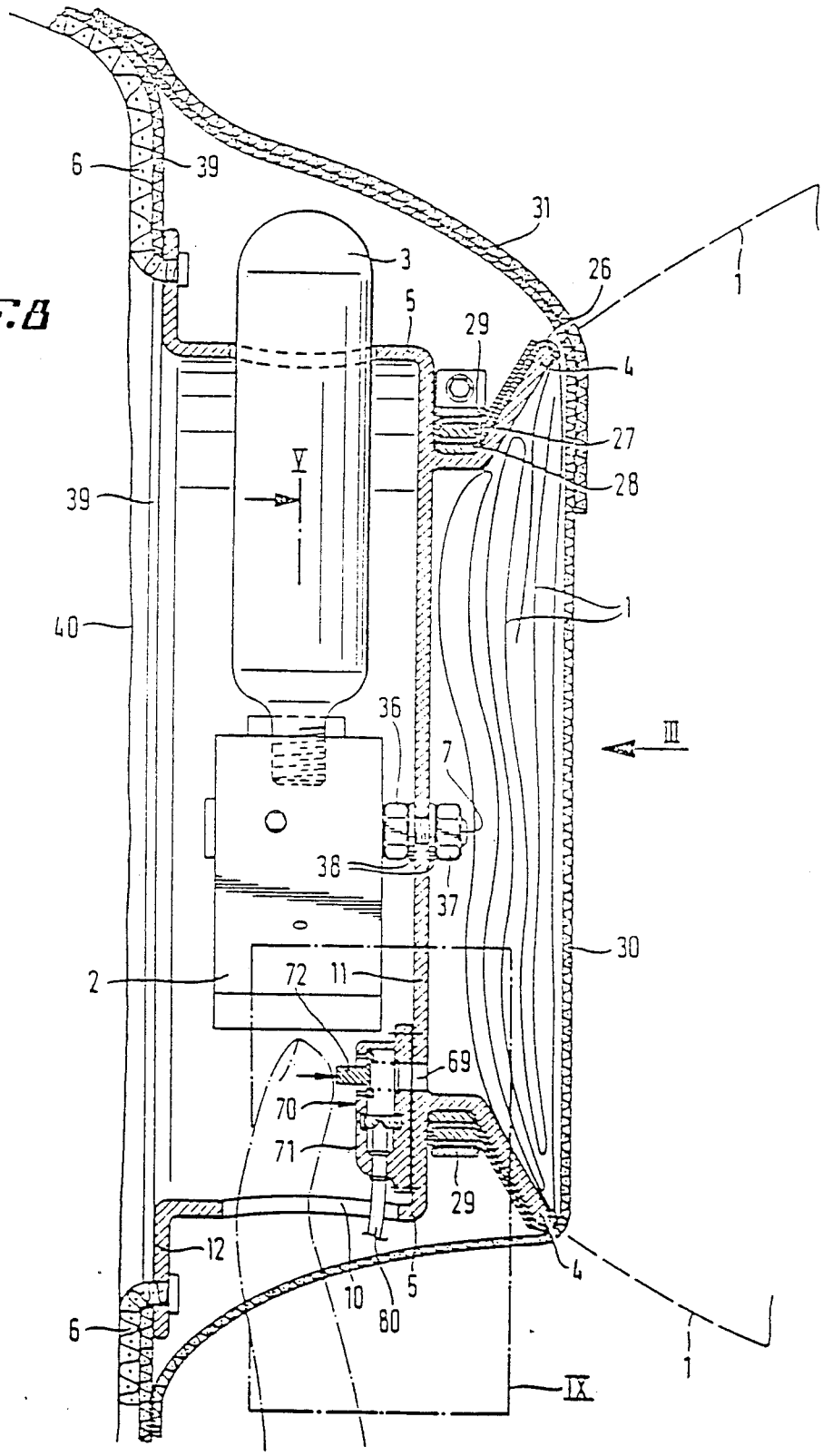
FIG. 8 is a cross section according to FIG. 4 with an additional valve device.
Figure 9:
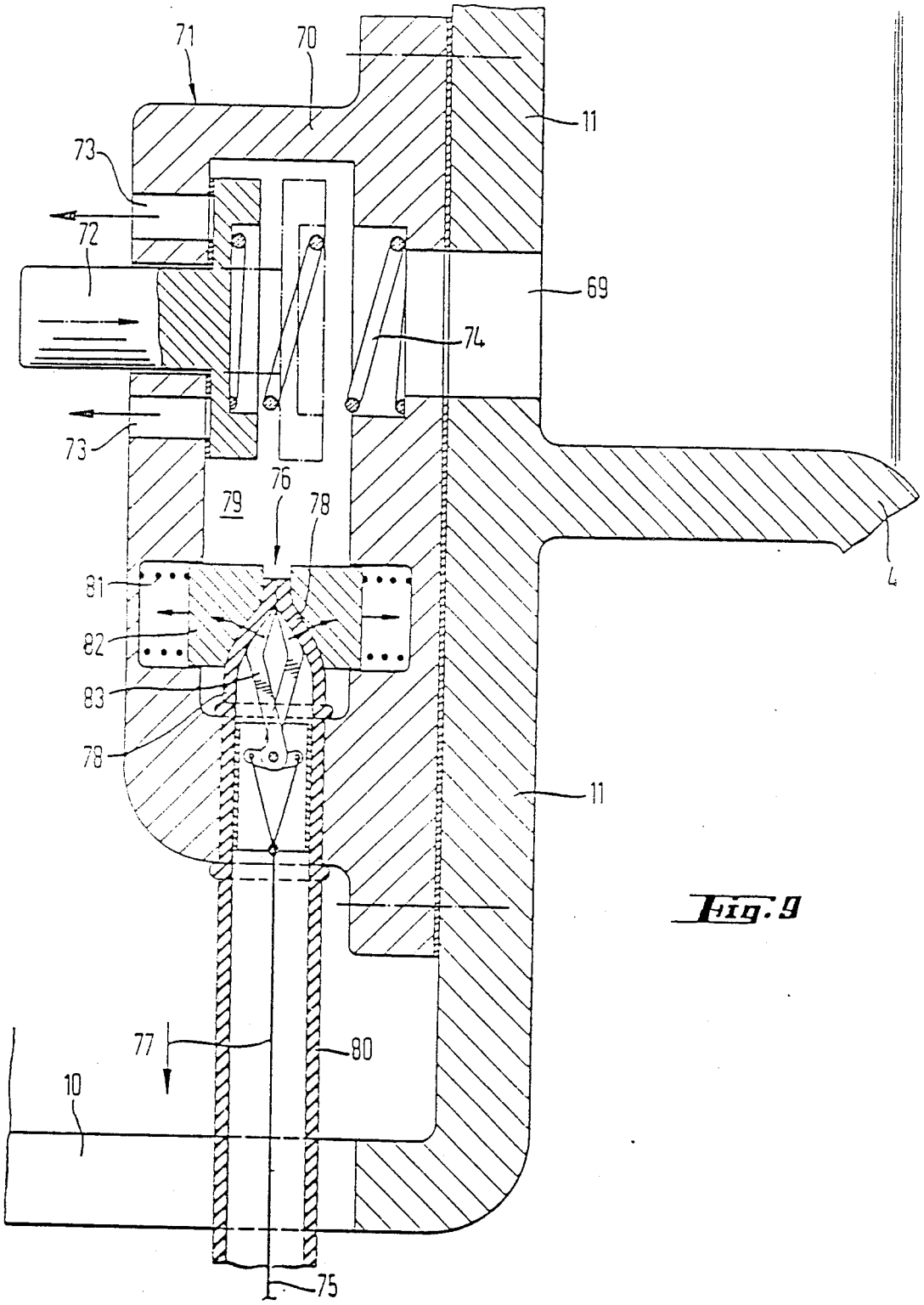
FIG. 9 shows detail IX in FIG. 8 in an enlarged scale.

According to FIG. 8, the frame bottom 11 has a bore 69 which opens on the side remote from the balloon 1 into the valve housing 70 of a valve device 71, shown to an enlarged scale in FIG. 9. The inflated balloon is emptied by applying finger pressure to a actuating button 72, whereby outwardly opening bores 73 in valve housing 70 are released. Actuating button 72 is kept in the closed position by means of a compression spring 74. By pulling in the direction of arrow 77 to line 75 of a non-return valve 76 which is inserted into valve housing 70 and is under the action of the internal pressure of the balloon, sealing lips 78 are pulled apart and a filling gas in ballon 1 flows out of inner chamber 79 of valve housing 70 through an inlet hose 80 connected to non-return valve 76, said hose 80 serving as an extraction hose in this case. This may be of importance when a person is buried in an avalanche and must supply himself with air from the balloon. With the flow in the opposite direction, hose 80 may also be used to fill the balloon with mouth or by means of an air pump. In this case sealing lips 78 open under the pressure of the inflowing air.

Conversely and as mentioned above, non-return valve 76 may also be opened by pulling on line 75 against the action of the internal pressure of the inflated balloon. In this case pressure elements 82 biased by compression springs 81 acting laterally on sealing lips 78 are forced apart by the spreading action of expanding tongs 83.

We claim:

1. Apparatus for rescuing persons in avalanches, said apparatus comprising a tear-resistant balloon (1) connected through a body-close connection to the wearer; said balloon (1) being inflated, during rescue action, by means of pressure gas so as to keep, like a floating body, its wearer on the surface of the avalanche; said apparatus also comprising a filling apparatus (2) to which one or more pressure gas bottles (3) are directly connected, said filling apparatus (2) being connected to the interior of said balloon through a valve, characterized in that the balloon (1) with its filling opening grip a collar part (4) of a rigid frame (5) in the interior of which is located said filling apparatus (2), and straps (6) which may be connected to the wearer are attached to the frame (5).

2. Apparatus according to claim 1, characterized in that the collar part (4) is located on a side of said frame (5) remote from the wearer's body and encloses one or more venturi nozzles which serve for filling.

3. Apparatus according to claim 1 characterized in that the filling apparatus (2) comprises an air suction aperture (9) secured by a non-return valve (8) the said aperture opening into the interior of said frame (5) and in that said frame (5) is connected through an opening (10) to the atmosphere.

4. Apparatus according to claim 1 characterized in that said frame (5) is in a pot-like form, the bottom 11 of the frame facing the filling opening of the balloon (1), the pot-edge (12) facing the wearer's back.

5. Apparatus according to claim 1 characterized in that a rip cord (13) guided in a flexible hose (14) is provided for valve actuation.

6. Apparatus according to claim 1 characterized in that a gas actuated release mechanism is provided which is connected to said filling apparatus (2) by a flexible pressure hose (15) for valve actuation.

7. Apparatus according to claim 6, characterized in that an additional pressure gas bottle (16) is connected to the end of the pressure hose (15) which is not connected to the filling apparatus (2) by a manually actuatable valve (17) for opening thereof.

8. Apparatus according to claim 1 characterized in that for each pressure gas bottle (3) directly connected to said filling apparatus (2), said filling apparatus (2) comprising a valve needle (18) adapted to move on releasing the apparatus and pierce the pressure gas bottle closure (19) and ducts provided in a housing block (20) of said filling apparatus (2), said ducts connecting the bore (21) of each valve needle (18) with a venturi nozzle (7) and an air suction slot (22) thereof to the air suction aperture (9) of the filling device (2).

9. Apparatus according to claim 8, characterized in that each valve needle (18) is seated upon a piston (23) guided in a cylinder chamber (24) in said housing block (20) of the filling apparatus (2), said piston

(23) being actuatable by means of a rip cord or by a gas actuated release device.

10. Rescue apparatus comprising a frame connectable to a wearer;

a filling mechanism located within said frame;

an inflatable tear-resistant balloon; and a means for connecting said balloon to said rigid frame and to said filling mechanism.

11. A method of rescue which comprises the steps of:

(a) attaching a frame to the body of the person that may need rescue;

(b) including a filling mechanism within said frame and connected to said balloon; and (c) including a tear-resistant balloon attached to said frame and fillable by said mechanism;

whereby operation of said mechanism when said frame is attached to said person causes said balloon to be filled and support said person.

12. Apparatus as defined in claim 10 wherein said frame includes an external collar and said balloon is attached to said collar.

13. Method as defined in claim 11 wherein said balloon is attached to said frame at an external collar thereof.

14. Apparatus as defined in claim 10 wherein said filling mechanism includes a venturi nozzle communicating with said balloon;

an air suction channel communicating with said venturi nozzle; and a gas pressure channel communicating with said venturi nozzle.

15. Apparatus as defined in claim 14 further including a non-return valve for controlling said air suction channel.

16. Apparatus as defined in claim 15 wherein said non-return valve closes when said gas pressure channel is first activated.

17. Apparatus as defined in claim 15 wherein said balloon is initially in a folded state and said non-return valve is closed when said gas pressure channel is activated with said balloon in its folded state.

18. Apparatus as defined in claim 16 wherein said non-return valve opens when said balloon expands and thereby permits said air suction channel to supplement said gas pressure channel in the filling of said balloon.

19. Apparatus as defined in claim 18 wherein said non-return valve closes when pressure ceases on said gas pressure channel.

* * * * *